US006913290B2

(12) United States Patent
Warriner et al.

(10) Patent No.: US 6,913,290 B2
(45) Date of Patent: Jul. 5, 2005

(54) ALBUM PAGE FOR STORING CARDS

(75) Inventors: Nathalie T. Warriner, Orchard Lake, MI (US); Marshall L. Weingarden, Haworth, NJ (US)

(73) Assignee: Cardswell, Ltd., Bloomfield, MI (US)

( * ) Notice: Subject to any disclaimer, the term of this patent is extended or adjusted under 35 U.S.C. 154(b) by 0 days.

(21) Appl. No.: 10/420,464

(22) Filed: Apr. 22, 2003

(65) Prior Publication Data

US 2004/0007866 A1 Jan. 15, 2004

Related U.S. Application Data

(60) Provisional application No. 60/374,450, filed on Apr. 22, 2002.

(51) Int. Cl.[7] ..... B42D 1/00

(52) U.S. Cl. ..... 281/38; 281/15.1; 40/530; 40/537

(58) Field of Search ..... 281/3.1, 5, 15.1, 281/31, 38; 402/79; D19/33; 40/530, 537, 490, 654.01, 776; 206/232, 311, 473

(56) References Cited

U.S. PATENT DOCUMENTS

| | | | | | |
|---|---|---|---|---|---|
| 4,447,973 | A | * | 5/1984 | Wihlke | 40/776 |
| 4,602,447 | A | * | 7/1986 | Feingold | 40/405 |
| 4,965,948 | A | * | 10/1990 | Ruebens | 40/537 |
| 5,713,684 | A | * | 2/1998 | Turecamo | 402/79 |
| 6,135,663 | A | * | 10/2000 | Tan | 402/79 |

* cited by examiner

*Primary Examiner*—Derris H. Banks
*Assistant Examiner*—J Williams
(74) *Attorney, Agent, or Firm*—White & Case LLP

(57) ABSTRACT

Album pages for storing cards securely in place without slipping are disclosed. The album pages comprise a pocket located on a backing sheet. In a further embodiment, the pages comprise a sleeve located on the opposite side from the pocket. When a card mounted within the inventive album pages, the cards are securely retained within the pages and do not slide. The cards can be any type of generally flat items, such as photographs, greeting cards, invitations, or postcards. The invention also comprises an album page containing the inventive pages.

11 Claims, 6 Drawing Sheets

ALBUM PAGE FOR STORING CARDS

This application claims the benefit under 35 U.S.C. §120 of U.S. provisional patent application No. 60/374,450, filed Apr. 22, 2002, the contents of which are incorporated herein in their entirety.

FIELD OF THE INVENTION

The present invention relates generally to storage albums and pages used therein. More specifically, the claimed invention is directed to album pages for storing cards securely in place without slipping while the pages are being turned.

BACKGROUND OF THE INVENTION

Albums can be used to store and preserve different types of cards. For example, collectors of greeting cards, postcards, photographs, brochures, stamps, or other generally flat items typically store their collections in an album or other type of portfolio for ready retrieval and viewing. Different types of albums are available for sale from various suppliers.

There is on the market a storage album for greeting cards. The album is a loose leaf-type binder that has heat-sealed polypropylene pages for storing the greeting cards. Each page has a clear plastic pocket or pockets that can accommodate a wide range of sizes of greeting cards. The center backing sheet is generally an opaque polypropylene, such as a black nonwoven fabric. Polypropylene is commonly used for such album pages because it is archival and less expensive than sheets of other plastics.

Although such greeting card album pages are generally usable for their intended purpose, they nevertheless have certain drawbacks. One drawback to such prior art album pages is that the greeting cards inserted into the pockets have a tendency to slide from the pages as the pages are turned. An example of a prior art album page is shown in FIG. 1A. For ease of manufacture, a front pocket is affixed to the right side of the front of the page, and a rear pocket is affixed to the left side of the back of the page. Vertically opening greeting cards mounted on the front of the page can be displayed and viewed in the conventional manner (FIGS. 1B front and 1C front). However, horizontally opening cards cannot be suitably displayed on the back of the page (FIGS. 1B back and 1C back). Due to the way the pages are constructed, horizontally opening greeting cards can only be inserted upside-down in the rear pocket if the frontfolds are to remain open for viewing the inside of the card. A horizontally opening greeting card inserted in the rear pocket must be removed and rotated 180° for viewing right-side up.

Album pages are typically manufactured from plastic materials. However, plastics such as polypropylene have a low coefficient of friction, and paper greeting cards which are inserted in pockets of such pages have a tendency to slide about in the albums. The greeting cards also sometimes slip out of the pockets, especially as the album pages are turned. When greeting cards are inserted in the album pages of FIG. 1 and the pages are turned (as shown in FIG. 2), the cards can slip down and out of the pockets, and consequently become bent, folded, or damaged.

With prior greeting card albums, the cards are generally either completely inserted into a pocket, and therefore the entire card must be removed from the pocket in order to view its contents; or only the backfolds are inserted into the pockets, and the frontfolds are generally free to flap about as the pages are turned. However, the flapping frontfold of one greeting card can engage the frontfold of another card mounted on the opposite page, causing the cards to slide about even more within the pockets.

Although drawbacks associated with vertically opening greeting cards have been described above, similar issues reside with album pages for horizontally opening greeting cards. That is, the cards can slip out of the pockets, when the album pages are turned or if the album is turned upside down.

In an attempt to prevent sliding of the cards from the pockets as the pages are turned, one manufacturer provides small double faced adhesive tabs to be affixed to the backfolds of the cards. However, this solution can be annoying to the consumer, and requires that the manufacture keep stock of an additional item which must be packaged and shipped with the album pages. In addition, over time, the adhesive can possibly damage the card.

Therefore, there is a need for improved album pages for secure storage of cards in the pockets of the album pages as the pages are turned.

SUMMARY OF THE INVENTION

The present invention is directed to addressing the above-described need for improved album pages.

According to one aspect of the present invention, an album page for storing one or more cards is provided. The album page comprises a backing sheet having front and back sides, each side having left and right portions; left, right, top and bottom edges; and a fastening edge for engagement with a fastener of an album. A vertical front pocket for receiving a first portion of a card is disposed over the right portion of the front side of the backing sheet, and is formed by a transparent overlay having upper, lower, and right side edges connected to the backing sheet. The page also comprises a vertical back pocket for receiving a first portion of a second card. The back pocket is disposed over the right portion of the back side of the backing sheet, and is formed by a transparent overlay and having upper, lower, and right side edges connected to the backing sheet. The fastening edge is located on the left side of the front side of the backing sheet; and on a right side of the back side of the backing sheet.

The album page may further comprise a vertical front sleeve for receiving a second portion of the first card, and a vertical back sleeve for receiving a second portion of the second card. The front sleeve is disposed over the left portion of the front side of the backing sheet, and is formed by a transparent overlay having upper, lower, and left side edges connected to the backing sheet. The back sleeve is disposed over the left portion of the back side of the backing sheet, and is formed by a transparent overlay having upper, lower, and left edges connected to the backing sheet.

According to another aspect of the claimed invention, another album page for holding and displaying one or more cards is provided. The album page comprises a backing sheet having front and back sides, each side having left and right portions; left, right, top and bottom edges; and a fastening edge on a left side of the album page for engagement with a fastener of an album. The album page comprises a vertical front pocket for receiving a first portion of a card. The vertical front pocket is disposed over the right portion of the front side of the backing sheet, and is formed by a transparent overlay having upper, lower, and right side edges connected to the backing sheet. The album page also comprises a vertical front sleeve for receiving a second portion of the card. The vertical front sleeve is disposed over the left portion of the front side of the backing sheet, and is formed by a transparent overlay having upper, lower, and left side edges connected to the backing sheet.

According to another aspect of the claimed invention, another album page is provided for storing one or more cards. The album page comprises a backing sheet having front and back sides, each side having upper and lower portions; left, right, top and bottom edges; and a fastening edge for engagement with a fastener of the album. A horizontal front pocket for receiving a first portion of a card is disposed over the lower portion of the front side of the backing sheet. The pocket is formed by a transparent overlay having lower, left, and right side edges connected to the backing sheet. A horizontal front sleeve for receiving a second portion of the card is disposed over the upper portion of the front side of the backing sheet. The sleeve is formed by a transparent overlay having upper, left, and right side edges connected to the backing sheet. The fastening edge of the album page is located on the top edge of the front side of the backing sheet; and on a bottom edge of the back side of the backing sheet.

In another embodiment of the claimed invention, the album page may further comprise a horizontal back pocket for receiving a first portion of a second card. The horizontal back pocket is disposed on the lower portion of the back side of the backing sheet, and formed by a transparent overlay and having lower, left, and right side edges connected to the backing sheet. A horizontal back sleeve for receiving a second portion of a second card is disposed on the upper portion of the back side of the backing sheet. The back sleeve is formed by a transparent overlay having upper, left, and right edges connected to the backing sheet.

In an embodiment of the invention, the first portion of a card inserted into the album page can be the backfold of a greeting card or the right portion of a postcard, stamp, or photograph, or another type of card or other item. The second portion of the card can be the spine of the greeting card, or the left side of the postcard, stamp, photograph, or other item.

In an embodiment of the invention, the album pages are formed from an archival or acid-free material. For example, the album pages can be manufactured from archival-quality polyethylene, polypropylene, or polyester. The archival quality of the album pages allows long-term storage of the cards without causing damage to the cards.

In another embodiment of the invention, the album pages can comprise one or more seams for separating each of a plurality of cards. The seam can be bonded to the backing sheet, creating two or more distinct pockets, sleeves, or both.

The album page may also comprise a plurality of pockets, sleeves, or both, disposed on each side of the backing sheet. That is, two or more pockets and two or more sleeves may be present on each side of the backing sheet.

Another aspect of the present invention is directed to greeting card albums comprising the instant album pages. The album comprises a binder having front and back covers, and a fastener for retaining one or more pages between the covers. The binder includes one or more of the album pages of the invention. The fastener may be a conventional three-ring fastener, a twin-loop spiral, a spiral coil binding, plastic comb binding, or any other type of fastener which can retain the pages of the album, without limitation. The fastener may be openable so that the user can add or remove page, or it can be non-openable so that pages are securely held within the album.

In one embodiment of the invention, the vertical pockets and sleeves extend across the entire length of the page, and the horizontal pockets and sleeves extend across the entire width of the page. In another embodiment, the pockets and sleeves do not extend across the entire length or width of the page, and stop before the end of the page. Also, the size and number of the pockets and sleeves on the backing sheet can vary depending upon the particular embodiment of the invention.

For ease of discussion, the items which can be stored in the claimed album pages are described as "cards". However, the items can be any generally flat articles, without limitation. Examples of items which can be stored in the claimed album pages are greeting cards, announcement cards, invitations, postcards, pamphlets, stamps, paper money, certificates, picture cards such as baseball cards, and photographs. The card or item is typically manufactured from paper, although it can be made from any other type of material, such as plastic or foil. In an embodiment of the invention, the album pages may also be used to secure and display three-dimensional items such as coins and bottle caps.

Although the fastening edge has been described as being located on the left or top sides of the front of the backing sheet, the fastening edge can be located at any particular portion of the backing sheet. For example, the fastening edge can be located on the bottom of the backing sheet, or on its right side. In another embodiment of the invention, there may be a plurality of fastening edges. For example, the fastening edge may be located on both the left and right sides of the backing sheet, for use in a special album which fastens both left and right sides of the album page, or to give the user the option of choosing which fastening edge to insert in a binder.

Although the pockets and sleeves disposed on the album pages have been described as being transparent, in an embodiment of the invention, they may also be tinted or colored, or have decorative designs printed or imprinted on them. The backing sheets can also be colored, tinted, imprinted, or otherwise attractively designed. For example, a page which has a birthday theme may comprise a pink backing sheet having clear pockets and sleeves disposed over the backing sheet. The pockets and sleeves may be imprinted with images of small birthday cakes, and the backing sheet may be imprinted with the expression "Happy Birthday".

The inventive album pages may also have a memo area for recording information about a particular card, such as the date received, occasion, purchase price, or other information deemed noteworthy. The memo area can be in any suitable location on the album page. In addition, the pockets or sleeves can be manufactured from a material which allows the user to write directly on them using a marker, ball-point pen, or other writing implement.

DETAILED DESCRIPTION OF THE INVENTION

The claimed invention will now be described with reference to the Figures, wherein like numerals indicate like elements. For purposes of illustration and discussion, a greeting card is shown mounted in the inventive pages. However, as already discussed, the invention is equally suitable for displaying and archiving postcards, brochures, invitations, pamphlets, currency, or any other generally flat items.

Figure 1:
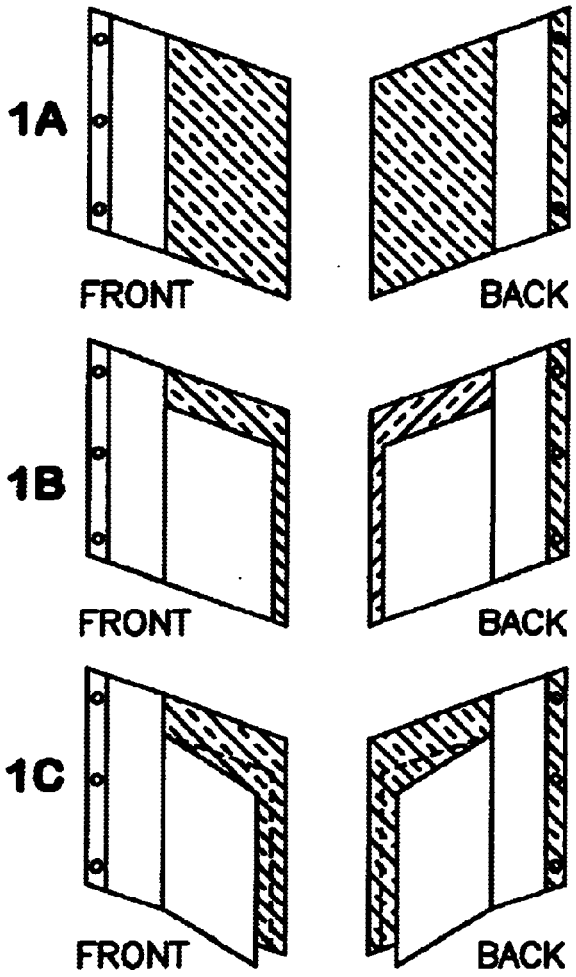
FIG. 1 PRIOR ART
FIGS. 1A–1C illustrate various perspective views of a prior art album page.
Figure 2:
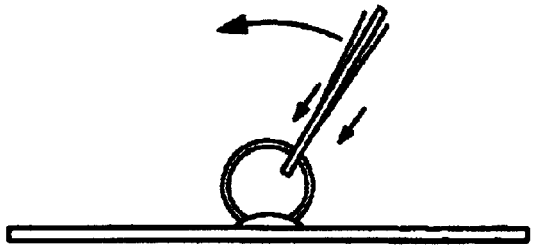
FIG. 2 PRIOR ART
FIG. 2 illustrates a perspective view of the album page of FIGS. 1A–1C fastened in an album, and greeting cards slipping out of the album pocket.
Figure 3:
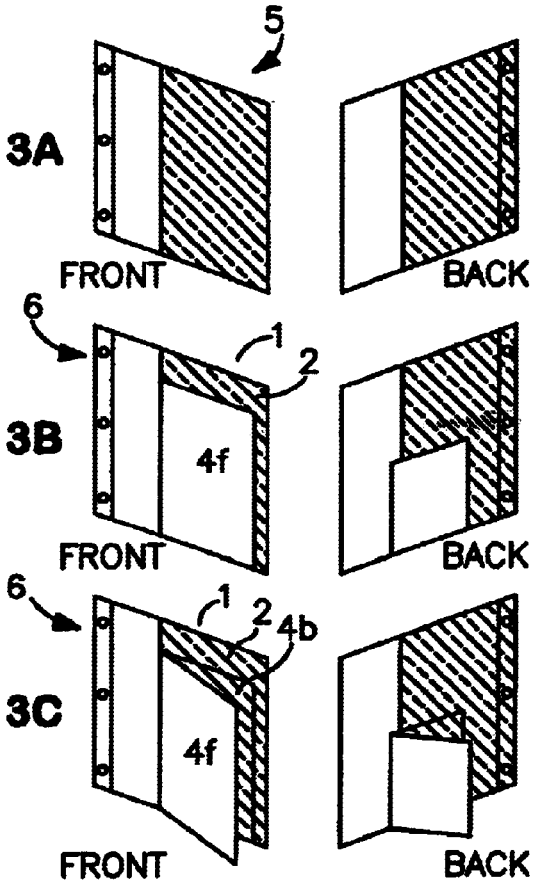
FIGS. 3A–3C illustrates various perspective views of an album page according to an embodiment of the present invention, wherein pockets are disposed on both sides of the album page.
Figure 4:
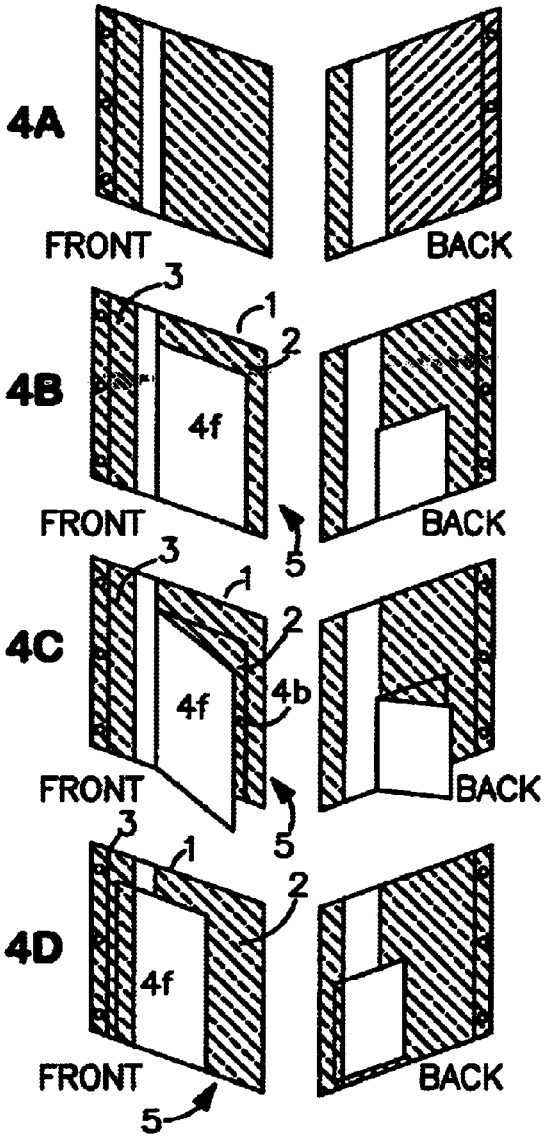
FIGS. 4A–4D illustrate various perspective views of another embodiment of the claimed invention, wherein pockets and sleeves are disposed on both sides of the album page.

FIGS. 3A–3D illustrate an album page according to an embodiment of the present invention. FIG. 3A illustrates the album page 5 without a card mounted. FIGS. 3B and 3C show a card mounted in the album page. The album page 5 consists of a backing sheet 1 onto which is overlaid a pocket 2. The pocket 2 is formed from a transparent overlay such as polypropylene, polyethylene, or polyester. The album page 5 has a fastening area 6 for engagement with a binder of an album (not illustrated). The pocket 2 is located at the right portion of the backing sheet 1 on both the front and the back sides of the album page 5. In FIG. 3B, a card having a frontfold 4*f* and a backfold 4*b* is mounted in the pocket for storage.

FIGS. 4A–4D and 5 illustrate another album page according to an embodiment of the claimed invention. The album page 5 consists of a backing sheet 1 onto which are overlaid a pocket 2 and a sleeve 3. The pocket 2 and the sleeve 3 are formed from a transparent archival overlay material such as polypropylene. The backing sheet 1 has top edge 11, bottom edge 13, left edge 15, and right edge 17. The album page 5 has a fastening area 6 for engagement with a binder of an album.

The pocket 2 is affixed to the right portion of the backing sheet 5. The top edge 21 and the bottom edge 23 of the pocket 2 are affixed to the top 11 and bottom 13 edges of the backing sheet 1, and the right side 27 of the pocket 2 is affixed to the right side 17 of the backing sheet 1. The left side 25 of the pocket is not affixed to the backing sheet 1 so that a greeting card can be inserted or mounted in the pocket 2.

The sleeve 3 is affixed to the left side of the backing sheet 1. The top 31 and bottom 33 edges of the sleeve 3 are affixed to the top 11 and bottom 13 edges of the backing sheet 1, and the left side 35 of the sleeve is affixed to the left side 15 of the backing sheet 1. The right side 37 of the sleeve 3 is not affixed to the backing sheet 1 and therefore is available to receive the spine of a greeting card.

FIG. 4B illustrates a greeting card inserted into a pocket of the inventive album page and in the stored position. The backfold of a greeting card 4 is inserted into the pocket 2, and the frontfold of the greeting card can be opened for reading the message inside.

To place a greeting card into the album, the backfold 4*b* of the card 4 is inserted into the pocket 2. The frontfold 4*f* of the card 4 is then free to be opened and closed as desired in order to view the inside contents of the greeting card 4. To place the card in the storage position, the card 4 is moved until its spine is inserted in the sleeve 3, as shown in FIG. 4D. The spine of the card is held securely by the sleeve and the card does not slip out of the pocket when the pages of the album are turned.

Figure 5:
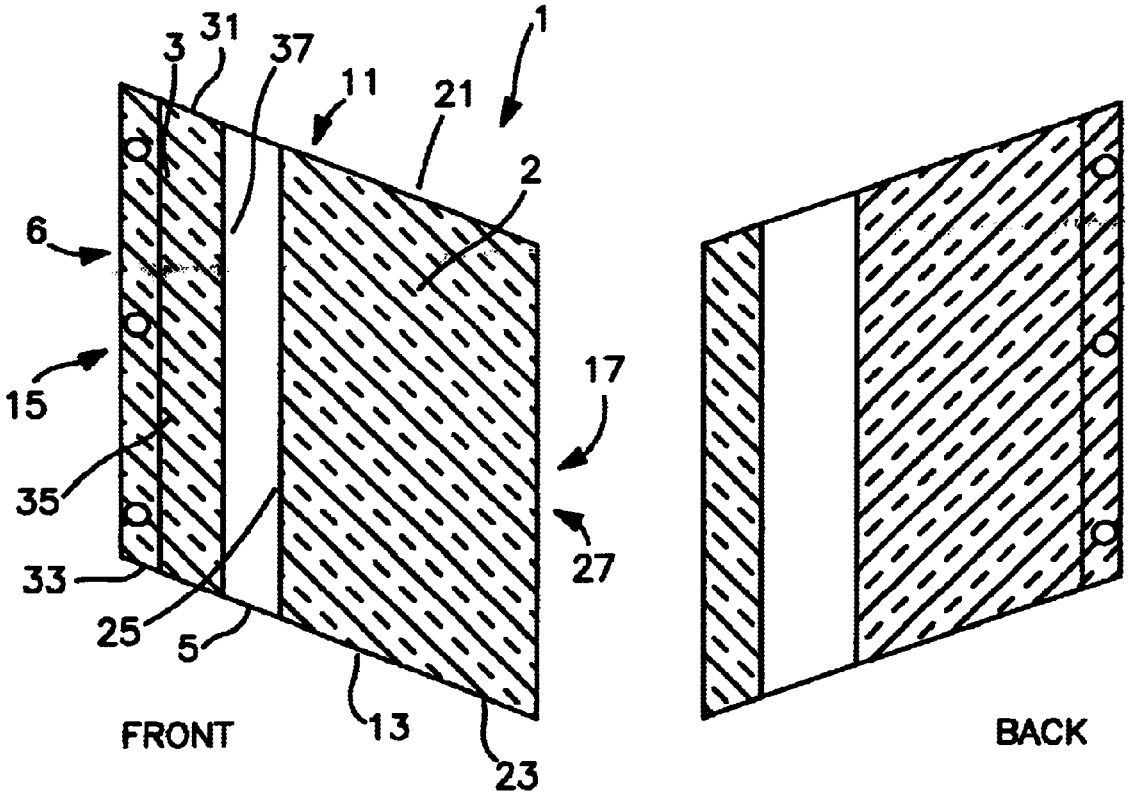
FIG. 5 illustrates a close-up view of FIG. 4A.
Figure 5A:
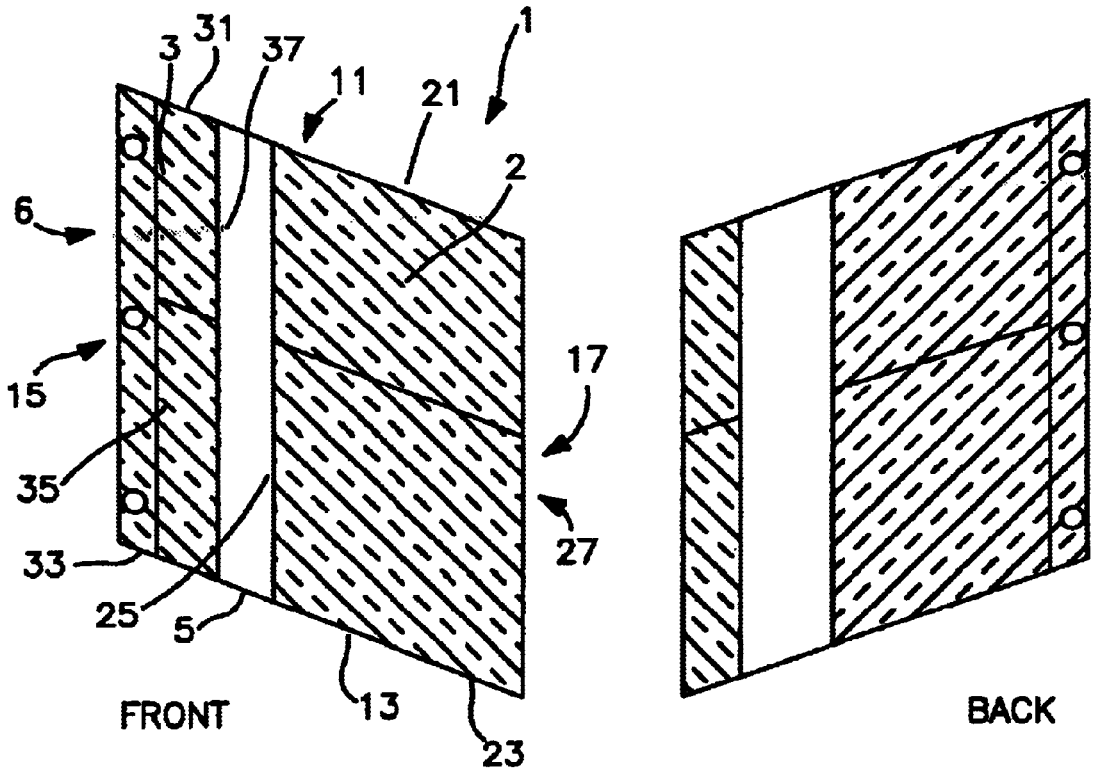
FIG. 5A illustrates another embodiment of the invention, wherein a horizontal seam can be used to separate each of a plurality of cards.
Figure 5B:
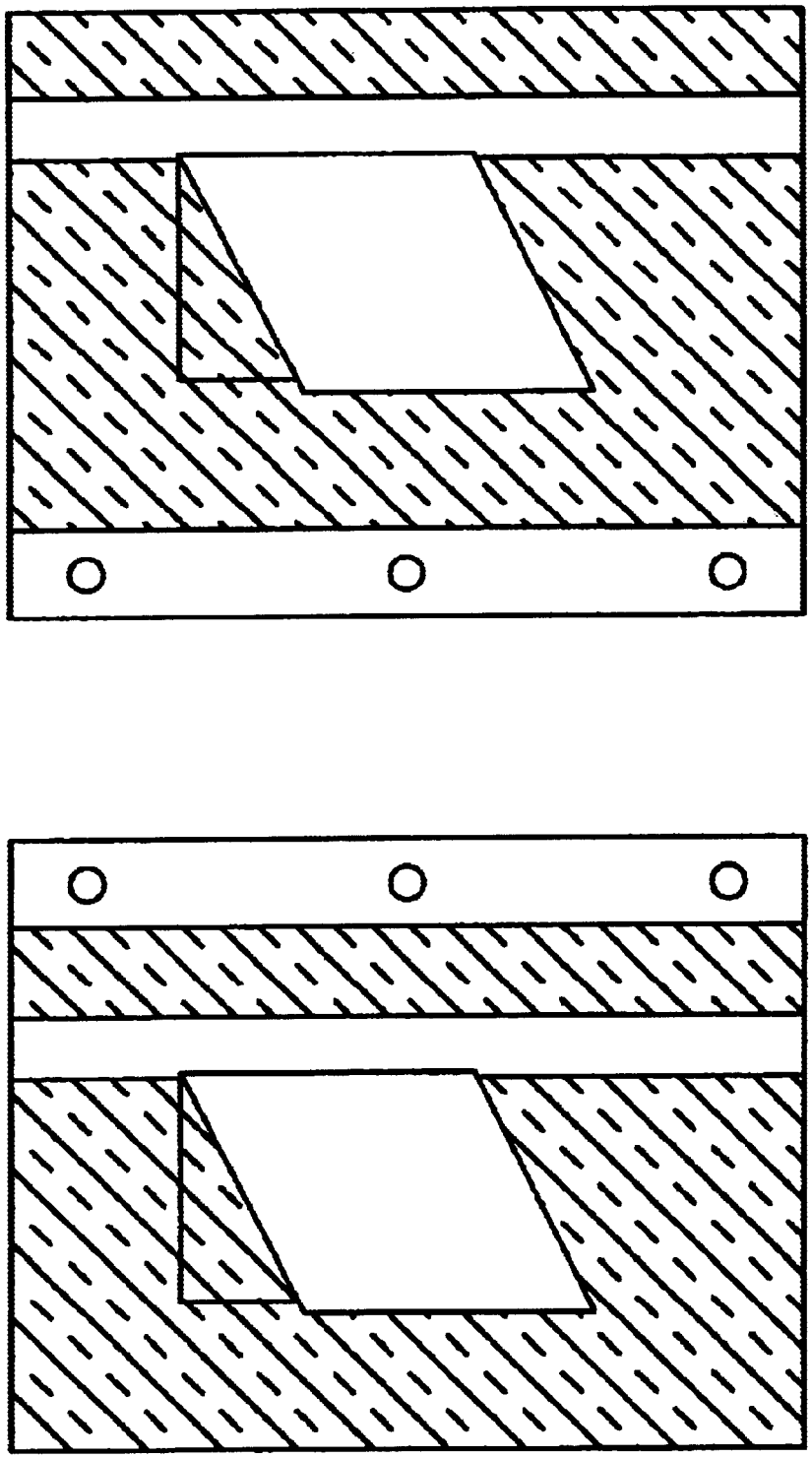
FIG. 5B illustrates another embodiment of the invention for displaying horizontally opening cards.

Although the album pages shown in FIGS. 2–5A are especially suitable for displaying vertically opening greeting cards, postcards, and other flat cards in the "portrait" orientation, the invention may also be successfully used to display horizontally opening greeting cards and other cards and items in the "landscape" orientation. In one embodiment (FIG. 5B), an album page for displaying horizontally opening greeting cards has a pocket on the lower portion of the page, with a sleeve on the upper portion of the page. The backfold of a greeting card is inserted into the pocket, and the spine of the greeting card is inserted into the sleeve. An album holding horizontally opening greeting cards according to this embodiment can be manipulated and even turned upside down without the cards slipping out of the album pages.

In a further embodiment of the invention, both the front and the back sides of the album pages have pockets and sleeves disposed on the pages. This feature permits efficient use of both sides of the display page.

Figure 6:
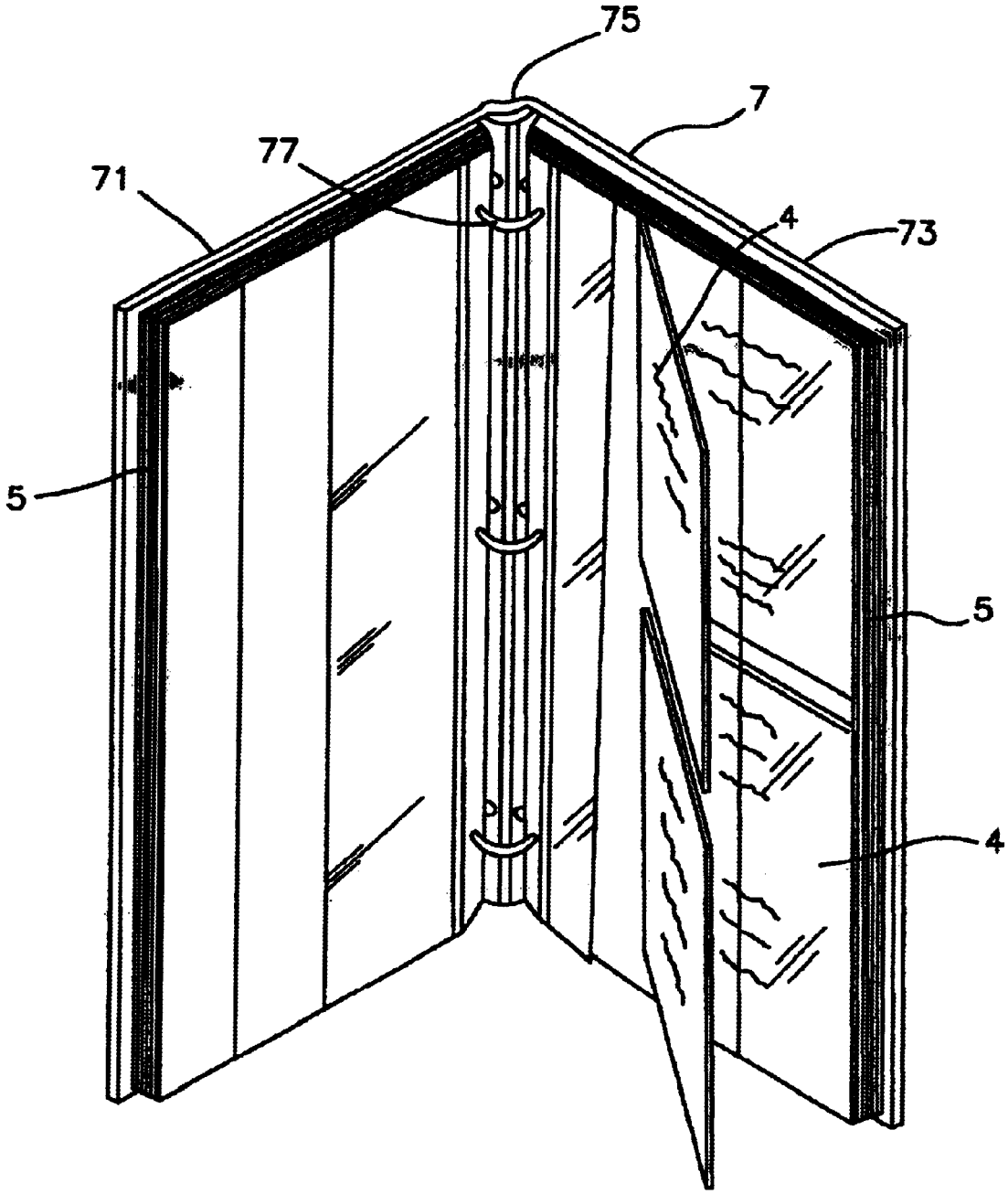
FIG. 6 illustrates a perspective view of an album according to an embodiment of the present invention and comprising the inventive album pages.

FIG. 6 shows a greeting card album in accordance with the invention. The album comprises a binder 7 having a front cover 71, a back cover 73, and a binder fastener 75 for retaining one or more pages 5 between the covers. In FIG. 6, the fastener 75 is shown as comprising a plurality of rings 77, which can be opened and closed in a conventional manner so that one or more pages 5 may be added to or removed from the binder 7. One or more pages 5 described above may be mounted in the album to store and display greeting cards 4. In addition, the front or back covers 71 and 73 could include a general purpose pocket (not shown) for storing oversized cards that may not fit within the pockets on the pages provided within the album.

The embodiment of the invention illustrated in FIG. 6 shows two greeting cards inserted side by side in one pocket. In one embodiment, the album pages are 8"×9", and the album is 10"×10". However, the pages may be of any size or dimension which are suitable or convenient for displaying greeting cards. The number of cards displayed on a page will vary depending on the size of the page and the size of the card(s), although typically about 1–3 cards will be displayed on a page.

In another embodiment of the invention, a plurality of pockets and sleeves are disposed on a single side of an album page. Such an embodiment permits additional cards to be mounted on one page of the album.

While the invention has been shown and described with reference to particular embodiments, those skilled in the art will understand that various changes in form and details may be made without departing from the spirit and scope of the invention. Any and all such variations are encompassed by the claims appended below.

What is claimed is:

1. An album page for holding and displaying one or more cards, the album page comprising:

a backing sheet having front and back sides, each side having left and right portions; left, right, top and bottom edges; and a fastening edge for engagement with a fastener of an album;

a vertical front pocket for receiving a first portion of a first card and disposed over the right portion of the front side of the backing sheet, the front pocket formed by a transparent overlay and having upper, lower and right side edges connected to the backing sheet;

a vertical front sleeve for receiving a second portion of the first card, the front sleeve disposed over the left portion of the front side of the backing sheet, the front sleeve formed by a transparent overlay and having upper, lower, and left side edges connected to the backing sheet;

a vertical back pocket for receiving a first portion of a second card and disposed over the right portion of the back side of the backing sheet, the back pocket formed by a transparent overlay and having upper, lower, arid right side edges connected to the backing sheet; and a vertical back sleeve for receiving a second portion of the second card, the back sleeve disposed over the left portion of the back side of the backing sheet, the back sleeve formed by a transparent overlay and having upper, lower, and left edges connected to the backing sheet, wherein the fastening edge is located on the left side of the front side of the backing sheet; and the fastening edge is located on a right side of the back side of the backing sheet;

the pockets receive the backfolds of the cards and the sleeves receive the spines of the cards; and the pockets are wider than the sleeves.

2. The album page according to claim 1, wherein the card is a generally flat item of memorabilia selected from the group consisting of a greeting card, announcement card, invitation, postcard, pamphlet, stamp, picture card, certificate, and photograph.

3. The album page according to claim 1, wherein the album page is formed from an archival or acid-free material.

4. The album page according to claim 1, wherein the pocket, sleeve, or both, comprise a horizontal scam for separating each of a plurality of cards.

5. The album page according to claim 1, further comprising a plurality of pockets, sleeves, or both, disposed on the backing sheet.

6. An album page for holding and displaying one or more cards, the album page comprising;

a backing sheet having front and back sides, each side having upper and lower portions; left, right, top and bottom edges; and a fastening edge for engagement with a fastener of the album;

a horizontal front pocket for receiving a flint portion of a first card and disposed over the lower portion of the front side of the backing sheet, the pocket formed by a transparent overlay having lower, left, and right aide edges connected to the backing sheet;

a horizontal front sleeve for receiving a second portion of a first card disposed over the upper portion of the front side of the backing sheet, the sleeve formed by a transparent overlay and having upper, left, and right side edges connected to the backing sheet;

a horizontal back pocket for receiving a first portion of a second card and disposed on the lower portion of the back side of the backing sheet, the back pocket formed by a transparent overlay and having lower, left, and right side edges connected to the backing sheet; and a horizontal back sleeve for receiving a second portion of a second card disposed on the upper portion of the back side of the backing sheet, the back sleeve formed by a transparent overlay and having upper, left, and right edges connected to the backing sheet, wherein the fastening edge is located on the top edge of the front side of the backing sheet; and the fastening edge is located on a bottom edge of the back side of the backing sheet;

the pockets receive the backfolds of the cards and the sleeves receive the spines of the cards; and the pockets are wider than the sleeves.

7. The album page according to claim 6, wherein the card is a generally flat item of memorabilia selected from the group consisting of a greeting card, announcement card, invitation, postcard, pamphlet, stamp, picture card, certificate, and photograph.

8. The album page according to claim 6, wherein the album page is formed from an archival or acid-free material.

9. The album page according to claim 6, further comprising a vertical seam for separating each of a plurality of greeting cards.

10. The album page according to claim 6, further comprising a plurality of pockets, sleeves, or both, disposed on the backing sheet.

11. An album for holding and displaying greeting cards, comprising:

a binder having front and back covers and a fastener for retaining one or more pages between the covers; and one or more of any of the album pages of claims 1, 2–5, 6, and 7–10, mounted within the fastener.

* * * * *